US005902169A

United States Patent [19]

Yamakawa

[11] Patent Number: 5,902,169

[45] Date of Patent: May 11, 1999

[54] TOY WITH CHANGING FACIAL EXPRESSION

[75] Inventor: Kazumi Yamakawa, Soka, Japan

[73] Assignee: Dah Yang Toy Industrial Co., Ltd, Tainan, Taiwan

[21] Appl. No.: 08/992,160

[22] Filed: Dec. 17, 1997

[51] Int. Cl.[6] ..... A63H 3/28

[52] U.S. Cl. ..... 446/338; 446/337; 446/340

[58] Field of Search ..... 446/337, 338, 446/321, 340

[56] References Cited

U.S. PATENT DOCUMENTS

| | | | |
|---|---|---|---|
| 3,672,096 | 6/1972 | Johmann | 446/338 |
| 3,851,418 | 12/1974 | Barlow | 446/338 |
| 4,030,239 | 6/1977 | White | 446/321 |
| 4,164,827 | 8/1979 | Palumbo | 446/338 |
| 4,294,033 | 10/1981 | Terzian | 46/118 |
| 4,710,145 | 12/1987 | Hall Vandis | 446/100 |
| 4,798,556 | 1/1989 | Vicars | 446/391 |
| 4,820,234 | 4/1989 | Isaf | 446/321 |
| 4,900,289 | 2/1990 | May | 446/342 |
| 4,921,459 | 5/1990 | Cook | 446/321 |
| 5,236,385 | 8/1993 | May | 446/300 |
| 5,407,376 | 4/1995 | Avital | 446/175 |
| 5,417,606 | 5/1995 | Kimura | 446/321 |
| 5,588,898 | 12/1996 | Ooba | 446/321 |
| 5,700,178 | 12/1997 | Cimerman | 446/301 |
| 5,727,982 | 3/1998 | Hurt | 446/352 |

*Primary Examiner*—Robert A. Hafer
*Assistant Examiner*—Kurt Fernstrom
*Attorney, Agent, or Firm*—Darby & Darby

[57] ABSTRACT

A toy has a changing facial expression and includes a hollow toy body with a torso section and a head section on the torso section. The head section has a front side formed with a face opening. The torso section is provided with a pair of forwardly extending arms that are mounted pivotally on two sides thereof. The arms have distal ends that hold a shielding member therebetween, and are pivotable on the torso section between a lowered position, where the shielding member uncovers the face opening, and a raised position, where the shielding member extends across the face opening to cover the face opening. A face member is disposed rotatably in the head section of the toy body and is formed with at least two face sections. The face member can be rotated to move a previous one of the face sections from alignment with the face opening and register another one of the face sections with the face opening when the arms are in the raised position.

13 Claims, 10 Drawing Sheets

TOY WITH CHANGING FACIAL EXPRESSION

BACKGROUND OF THE INVENTION

1. Field of the Invention

The invention relates to toys, more particularly to a toy with a changing facial expression.

2. Description of the Related Art

Numerous toys have been proposed in the past which have the ability to provide a changing facial expression. U.S. Pat. No. 4,294,033 teaches an animated talking doll with a mouth area that is movable between open and closed positions while air passes through a sounding mechanism to generate an audible sound. U.S. Pat. No. 4,710,145 teaches a therapeutic doll figure with eyes and a mouth that are attached removably on a head section of a doll body for altering the facial expression of the doll figure. U.S. Pat. No. 4,798,556 teaches an article which has a changeable-expression face and which includes three independently moveable facial components that are mounted rotatably on a facing plate and that correspond to a mouth and two eyes on a face of the article. U.S. Pat. No. 4,820,234 teaches a doll which includes a plurality of independent and exchangeable facial segments that are built upon a post to create a doll face, the facial segments having a plurality of expressions selectively and separately placed into view to effect mood changes. U.S. Pat. No. 4,900,289 teaches a mechanism for animating a doll's facial features which incorporates a motor for powering jaw, eye and eyelid motion. U.S. Pat. No. 5,407,376 teaches a voice-responsive doll eye mechanism for providing doll eye motion in response to a voice.

SUMMARY OF THE INVENTION

The main object of the present invention is to provide a toy having a face member that rotates while covered by a shielding member to change the facial expression of the toy.

Another object of the present invention is to provide a toy that generates different sound outputs in accordance with the facial expression of the toy.

A further object of the present invention is to provide a toy with a light sensing unit to control rotation of the face member in response to a change in the light intensity that is detected thereby.

Accordingly, the toy with changing facial expression of the present invention comprises:

a hollow toy body having a torso section and a head section on the torso section, the head section having a front side formed with a face opening, the torso section being provided with a pair of forwardly extending arms that are mounted pivotally on two sides of the torso section, the arms having distal ends that hold a shielding member therebetween, and being pivotable on the torso section between a lowered position, where the shielding member uncovers the face opening, and a raised position, where the shielding member extends across the face opening to cover the face opening;

an inner casing disposed in the toy body and having top and bottom portions;

a circuit unit including a control circuit and a motor mounted on the bottom portion of the inner casing and connected electrically to the control circuit;

a drive mechanism including a main shaft disposed horizontally in the inner casing and mounted rotatably to the inner casing, the main shaft being coupled to the motor for axial rotation of the main shaft when the motor is activated by the control circuit, the main shaft having an arm control cam member and a face changing control cam member mounted thereon, a horizontal arm pivoting shaft mounted rotatably on the inner casing below the main shaft, the arm pivoting shaft having opposite ends that extend out of the inner casing and that have the arms of the toy body connected respectively thereto, an elongate control plate mounted securely on the arm pivoting shaft for co-rotation therewith, the control plate having upper and lower ends, and an arm control spring interconnecting the lower end of the control plate and the inner casing for biasing the control plate to rotate the arm pivoting shaft and pivot the arms from the lowered position to the raised position, the arm control cam member pressing against the upper end of the control plate during rotation of the main shaft to rotate the control plate and pivot the arms from the raised position to the lowered position against action of the arm control spring, and disengaging the upper end of the control plate to pivot the arms from the lowered position to the raised position due to the action of the arm control spring;

a hollow face member sleeved rotatably on the top portion of the inner casing and disposed in the head section of the toy body, the face member being formed with at least two face sections; and a face changing mechanism including an upright rotary shaft mounted rotatably on the inner casing and having an upper end which extends through the inner casing and which is connected to the face member for rotating the face member therewith, the rotary shaft further having a lower end provided with a transmission gear, and a clutch unit mounted on the inner casing and operable in an engaging mode, where the clutch unit couples the motor and the transmission gear such that rotation of the motor results in corresponding rotation of the rotary shaft, and a disengaging mode, where the clutch unit disengages the transmission gear from the motor to prevent the motor from driving rotatably the rotary shaft, the face changing control cam member operating the clutch unit in the engaging mode during rotation of the main shaft to rotate the face member so as to move a previous one of the face sections from alignment with the face opening and register another one of the face sections with the face opening while the arms are in the raised position, and in the disengaging mode to stop rotation of the face member by the motor when the arms are in the lowered position so that the another one of the face sections is visible from the face opening.

The main shaft further has a locking control cam member mounted thereon. The rotary shaft is formed with at least two angularly spaced locking grooves that correspond respectively to the face sections on the face member. The face changing mechanism further includes a locking plate, a locking control spring, and a control arm. The locking plate is retained pivotally in the inner casing on one side of the rotary shaft. The locking plate is provided with a locking projection for engaging one of the locking grooves to arrest rotation of the face member relative to the inner casing when the arms are in the lowered position. The locking control spring has one end connected to the locking plate, and an opposite end connected to the inner casing to bias the locking plate toward the rotary shaft for secure engagement between the locking projection and the rotary shaft. The control arm is mounted pivotally on the inner casing and has an upper end connected pivotally to the locking plate, and a lower end. The locking control cam member abuts against the lower end of the control arm during rotation of the main shaft to pivot the control arm and move the locking plate away from the rotary shaft against action of the locking control spring to permit rotation of the rotary shaft when the arms are moved to the raised position, and disengages the lower end of the control arm to permit movement of the locking plate toward the rotary shaft due to the action of the locking control spring when the arms are moved to the lowered position.

Preferably, the rotary shaft is formed with at least two radial projections that correspond to the face sections, that are spaced apart in an axial direction of the rotary shaft, and that are angularly spaced apart on the rotary shaft. The locking plate has at least two sound select contacts corresponding to the radial projections provided thereon and connected electrically to the control circuit. One of the sound select contacts is contacted by a corresponding one of the radial projections when the locking projection engages one of the locking grooves. The circuit unit further includes a speaker mounted to the bottom portion of the inner casing and connected electrically to and controlled by the control circuit so as to generate an audible sound output corresponding to the contacted one of the sound select contacts.

In the disclosed embodiment, the circuit unit further includes a light sensing unit mounted on the toy body and connected electrically to the control circuit to permit activation of the motor by the control circuit upon detection of a change in light intensity, and a circuit contact set mounted on the inner casing and connected electrically to the control circuit to permit deactivation of the motor by the control circuit when the circuit contact set is depressed. The main shaft further has a cycle control cam member mounted thereon for depressing the circuit contact set upon completion by the main shaft of one cycle of rotation.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
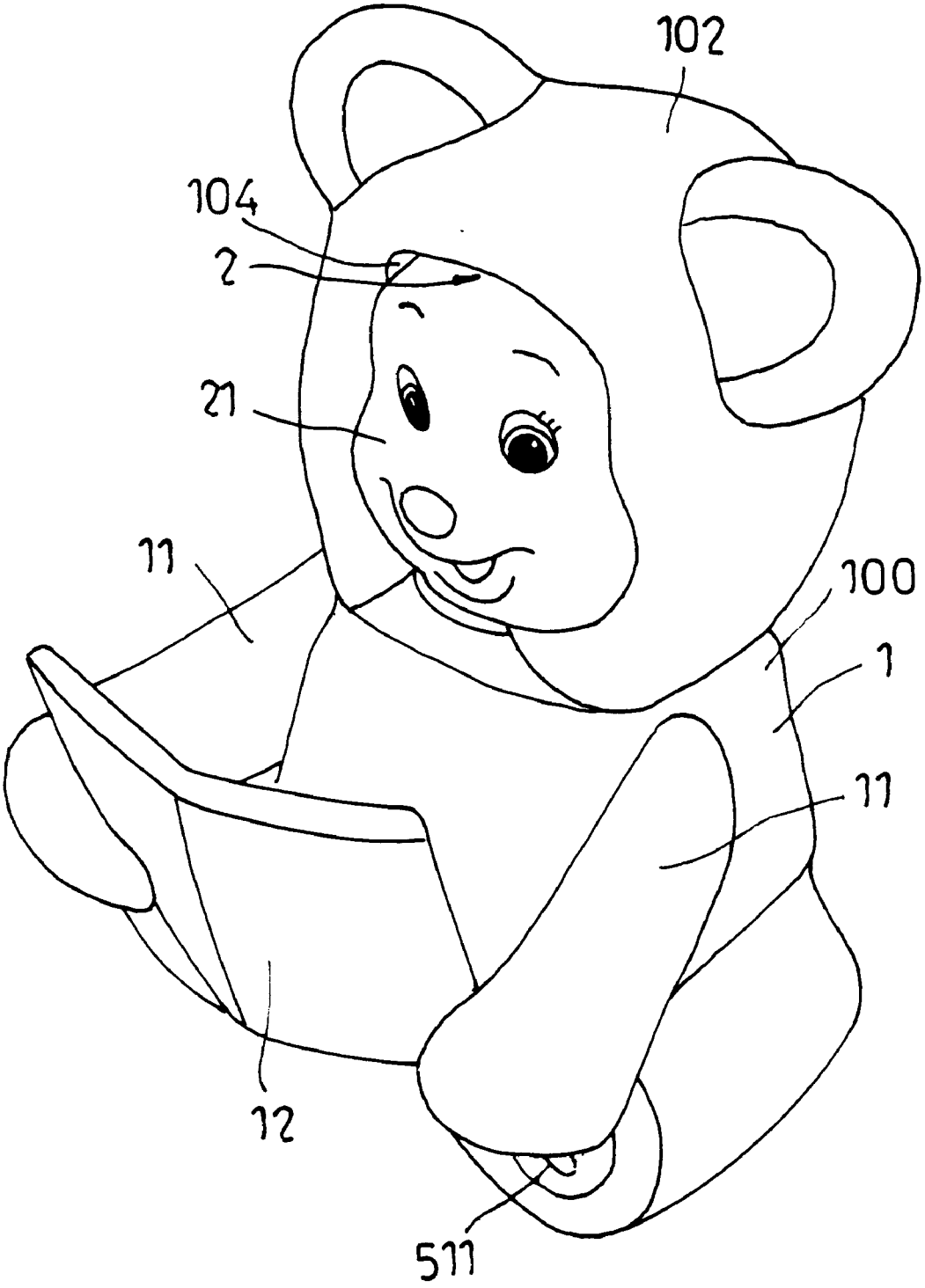
FIG. 1 is a perspective view of the preferred embodiment of a toy with a changing facial expression according to the present invention.
Figure 9:
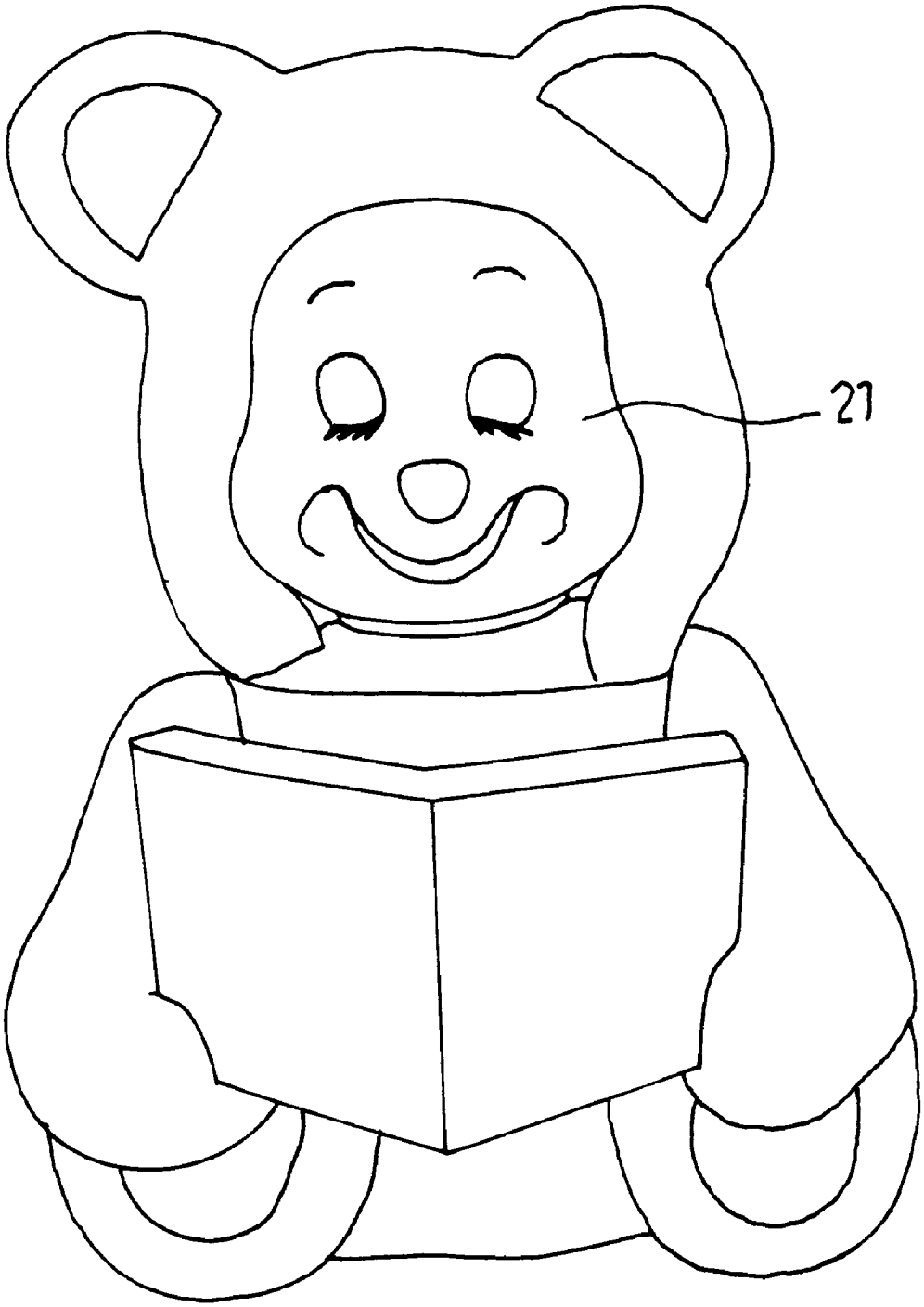
FIG. 9 is a schematic front view illustrating the preferred embodiment with a sleeping facial expression.
Figure 10:
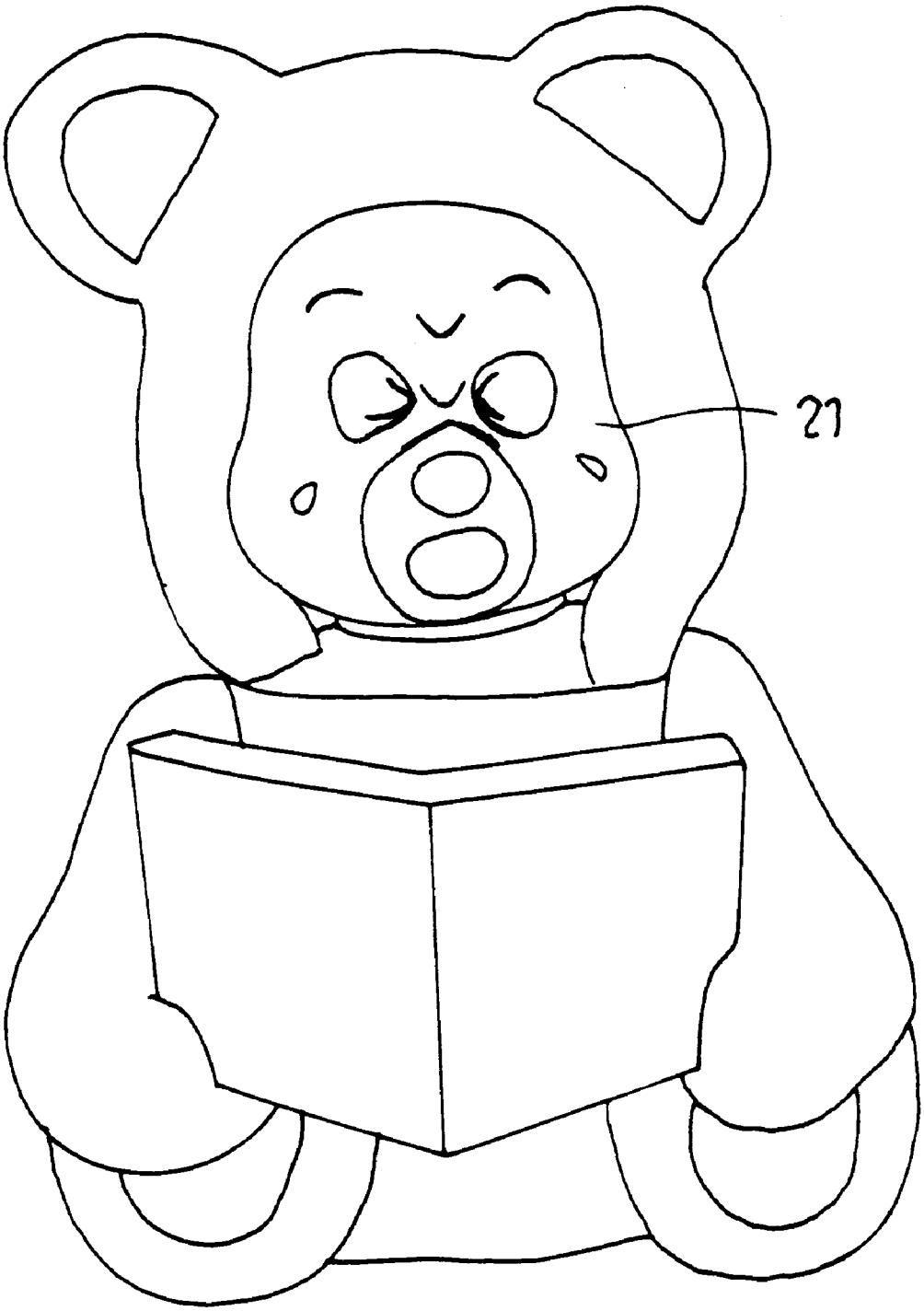
FIG. 10 is a schematic front view illustrating the preferred embodiment with a crying facial expression.

Referring to FIG. 1, the preferred embodiment of a toy with a changing facial expression according to the present invention is shown to comprise a hollow toy body 1 having the appearance of an animal, and an outer surface provided with a fur layer. The toy body 1 has a torso section 100 and a head section 102 on the torso section 100. The head portion 102 has a front side formed with a face opening 104. A pair of forwardly extending arms 11 are mounted pivotally on two sides of the torso section 100. The arms 11 have distal ends that hold a shielding member 12 therebetween. The arms 11 are pivotable upwardly and downwardly relative to the torso section 100. A hollow face member 2 is disposed rotatably in the head section 102 and is formed with at least two face sections 21. In this embodiment, the face member 2 has three adjacent face sections 21 with different facial expressions. The face sections 21 of the face member 2 are capable of protruding out of the face opening 104 when registered with the same so that only one of the face sections 21 is visible from the face opening 104. When the arms 11 are pivoted upwardly, the shielding member 12 extends across the face opening 104 to cover the latter. At this time, the face member 2 is rotated to move a previous one of the face sections 21 from alignment with the face opening 104 and register another one of the face sections 21 with the face opening 104. Thus, when the arms 11 are pivoted downwardly such that the shielding member 12 ceases to cover the face opening 104, a different facial expression can be seen on the toy. Therefore, the facial expression of the toy can change from a smiling facial expression (see FIG. 1) to a sleeping facial expression (see FIG. 9) or a crying facial expression (see FIG. 10).

Figure 2:
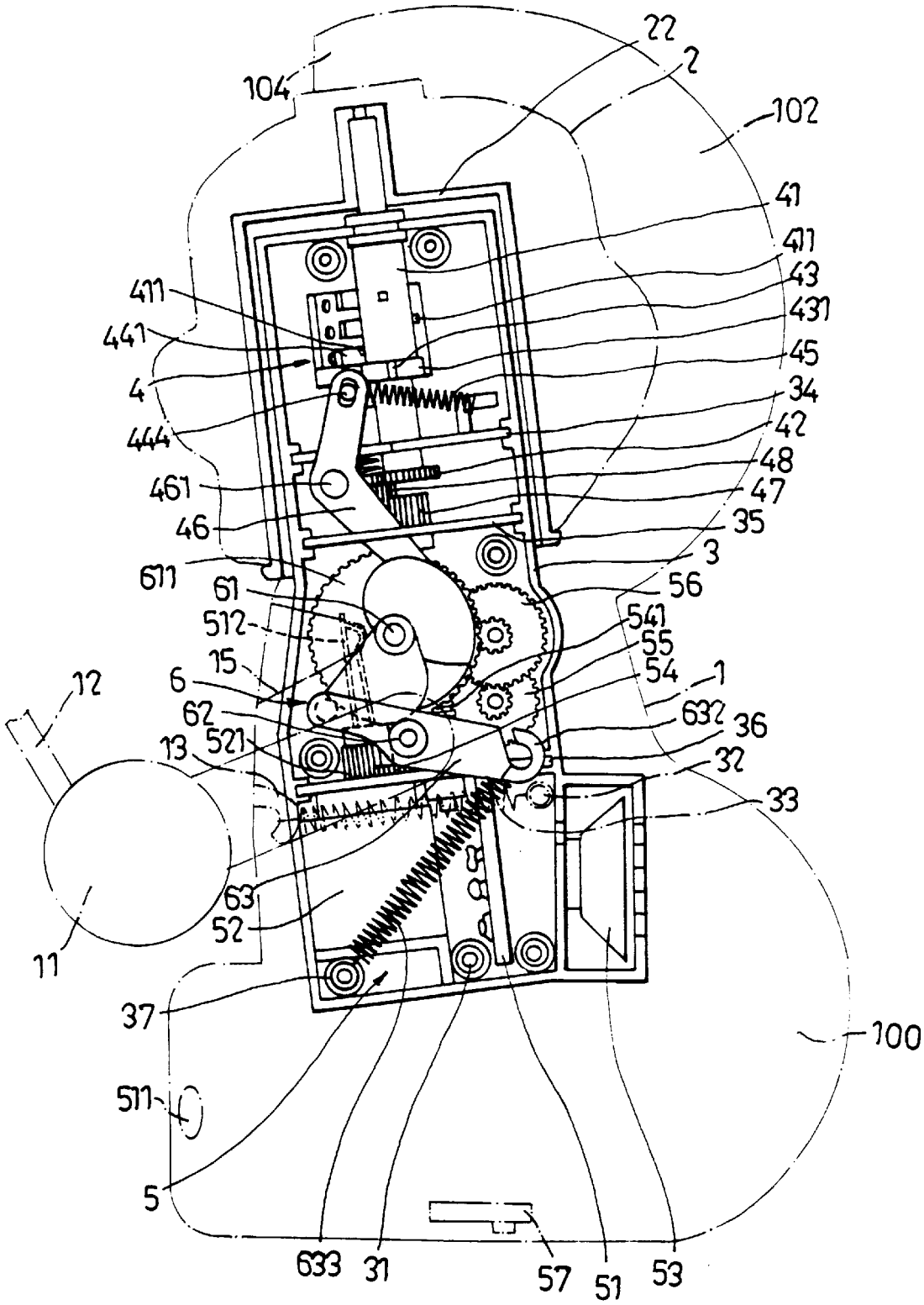
FIG. 2 is a schematic side view illustrating the preferred embodiment while the arms thereof are in a lowered position.

Referring to FIG. 2, an inner casing 3 is disposed in the toy body 1 for mounting of the various components of the toy thereon. The inner casing 3 has a bottom portion mounted pivotally in the torso section 100 of the toy body 1 by means of a pivot shaft 31. As such, the inner casing 3 is pivotable forwardly and rearwardly inside the toy body 1. The face member 2 is sleeved rotatably on a top portion of the inner casing 3. A stub 32 is formed on the bottom portion of the inner casing 3 adjacent to a rear edge of the same. A tension spring 33, which serves as a casing control spring, has one end connected to the stub 32, and an opposite end connected to a hook 13 on an inner surface of the toy body 1, thereby biasing the inner casing 3 to pivot forwardly inside the toy body 1 so that the face member 2 protrudes out of the head portion 102 at the face opening 104.

Figure 3:
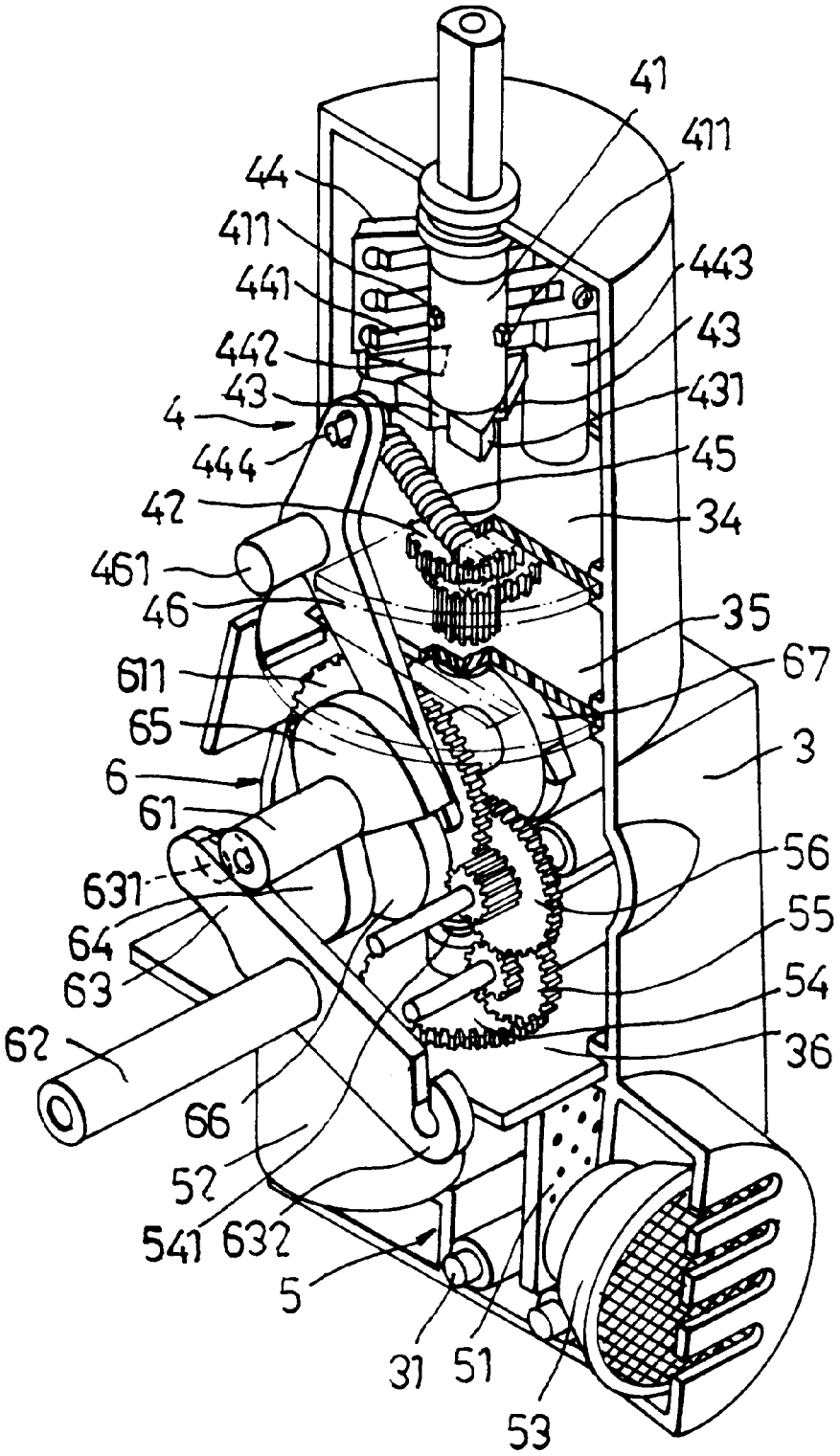
FIG. 3 is a perspective view illustrating a face changing mechanism, a circuit unit, and a drive mechanism of the preferred embodiment.

Referring to FIG. 3, the inner casing 3 is formed with horizontal first, second and third partition plates 34, 35, 36. The second partition plate 35 is disposed below the first partition plate 34, whereas the third partition plate 36 is disposed below the second partition plate 35. The space above the first partition plate 34 houses a face changing mechanism 4. The space below the third partition plate 36 houses a circuit unit 5. The space between the second and third partition plates 35, 36 houses a drive mechanism 6.

The face changing mechanism 4 includes an upright rotary shaft 41 which is mounted rotatably on the first partition plate 34. The rotary shaft 41 has an upper end which extends upwardly and rotatably through a top wall of the inner casing 3. The face member 2 has a tubular inner sleeve 22 provided therein. When the face member 2 is sleeved on the top portion of the inner casing 3, the inner sleeve 22 engages the upper end of the rotary shaft 41 such that axial rotation of the rotary shaft 41 will result in corresponding axial rotation of the face member 2. The rotary shaft 41 further has a lower end which extends downwardly and rotatably through the first partition plate 34 and which is provided with a transmission gear 42.

The intermediate portion of the rotary shaft 41 between the top wall and the first partition plate 34 of the inner casing 3 is formed with three radial projections 411 (only two are shown in FIG. 3) that correspond to the face sections 21, that are spaced apart in an axial direction of the rotary shaft 41, and that are arranged in 120° intervals on the surface of the rotary shaft 41. The intermediate portion of the rotary shaft 41 is further formed with three angularly spaced locking grooves 43 that also correspond to the face sections 21 and that are disposed above the first partition plate 34. Each of three triangular guide plates 431 projects radially from the rotary shaft 41 and is disposed between a corresponding adjacent pair of the locking grooves 43.

On one side of the rotary shaft 41, there is disposed an upright locking plate 44. Three sound select contacts 441 corresponding to the radial projections 411 on the rotary shaft 41 are provided on the locking plate 44 and are connected electrically to the control unit 5. The locking plate 44 is further provided with a triangular locking projection 442 adjacent to a first vertical edge thereof for engaging one of the locking grooves 43 to arrest rotation of the face member 2 relative to the inner casing 3. The opposite second vertical edge of the locking plate 44 is mounted pivotally on the first partition plate 34 by means of a pivot joint 443. At the bottom portion of the locking plate 44 adjacent to the locking projection 442, there is provided a stub 444. One end of a tension spring 45, which serves as a locking control spring, is connected to the stub 444. The other end of the tension spring 45 is connected to the first partition plate 34, thereby biasing the locking plate 44 to pivot toward the rotary shaft 41 for secure engagement between the locking projection 442 and one of the locking grooves 43 of the rotary shaft 41. At the same time, one of the sound select contacts 441 on the locking plate 44 is contacted by the corresponding one of the radial projections 411 on the rotary shaft 41.

A bent control arm 46 is responsible for controlling the pivoting movement of the locking plate 44 away from the rotary shaft 41 against the action of the tension spring 45. The control arm 46 has an upper end connected pivotally to the stub 444 on the locking plate 44, and a lower end which extends downwardly through the first and second partition plates 34, 35 for actuation by the drive mechanism 6, as will be described hereinafter. The control arm 46 further has a bent section that is mounted pivotally on the inner casing 3 at a pivot shaft 461.

Figure 4:
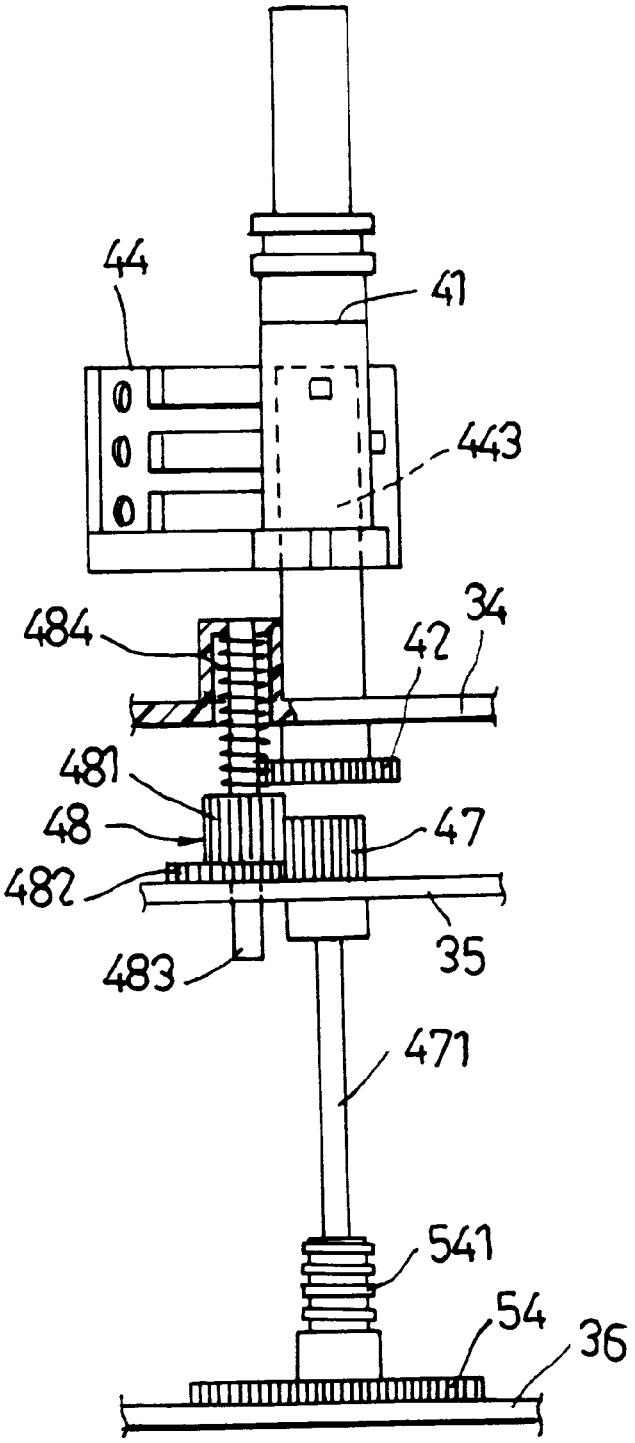
FIG. 4 is a schematic side view illustrating the connection between a clutch unit of the face changing mechanism and the drive mechanism of the preferred embodiment.

Referring to FIG. 4, a drive gear 47 and a clutch unit 48, which meshes with the drive gear 47, are installed on the second partition plate 35. The drive gear 47 has an axle 471 that extends downwardly and rotatably through the second partition plate 35 toward the third partition plate 36 for coupling with the circuit unit 5. The clutch unit 48 includes upper and lower clutch gears 481, 482. The upper clutch gear 481 is mounted securely on a gear axle 483. A spring 484 is sleeved on an upper part of the gear axle 483 and biases the upper clutch gear 481 toward the lower clutch gear 482. The lower part of the gear axle 483 extends through the second partition plate 35 for actuation by the drive mechanism 6, as will be described in the succeeding paragraphs. Once actuated, the gear axle 483 will be forced to move upward to enable the upper clutch gear 481 to mesh with both the drive gear 47 and the transmission gear 42 on the rotary shaft 41, thereby transmitting the rotation of the drive gear 47 to the rotary shaft 41.

Referring again to FIGS. 2 and 3, the circuit unit 5 includes a motor 52 and a speaker 53 mounted on the bottom portion of the inner casing 3, and a control circuit 51 connected electrically to the motor 52 and the speaker 53 to control the operations of the same.

The motor 52 has a motor shaft 521 which is coupled to the drive mechanism 6 by means of three speed-reducing gear units 54, 55, 56. The speed-reducing gear unit 54 is provided with a worm gear 541 for coupling with the speed-reducing gear unit 55. In addition, the axle 471 of the drive gear 47 also serves as the axle for the speed-reducing gear unit 54, as shown in FIG. 4. Thus, rotation of the motor shaft 521 will result in corresponding rotation of the drive gear 47. The control circuit 51 is connected electrically to a light sensing unit 511 and a circuit contact set 512. The light sensing unit 511 is mounted on the torso section 100 of the toy body 1 at a front side of the latter. In response to a change in the intensity of light that is detected by the light sensing unit 511, such as when a human body part is placed directly in front of the light sensing unit 511, the control circuit 51 can be enabled to activate the motor 52. The circuit contact set 512 is mounted on the third partition plate 36 and disables the control circuit 51 to deactivate the motor 52 when the circuit contact set 512 is depressed. The control circuit 51 is further connected electrically to a select switch 57 mounted on a bottom side of the toy body 1. In this embodiment, the select switch 57 is a three-position switch that is operable so as to control the mode of operation of the circuit unit 5. Thus, the circuit unit 5 can be selectively turned off or operated in an automatic mode, where the light sensing unit 511 and the circuit contact set 512 enable and disable the control circuit 51 to control activation and deactivation of the motor 52, or in a continuous mode, where the motor 52 is continuously activated by the control circuit 51 regardless of the status of the light sensing unit 511 and the circuit contact set 512.

The drive mechanism 6 includes a main shaft 61 disposed horizontally in the inner casing 3 and having opposite ends mounted rotatably on two sides of the inner casing 3. The main shaft 61 has a gear member 611 coupled to the speed-reducing gear unit 56 to permit axial rotation of the main shaft 61 when the motor 52 is activated. A horizontal arm pivoting shaft 62 is mounted rotatably on the inner casing 3 below the main shaft 61, and has opposite ends that extend out of the inner casing 3. The arms 11 are connected respectively to the opposite ends of the arm pivoting shaft 62. An elongate control plate 63 has an intermediate portion mounted securely on the arm pivoting shaft 62 for co-rotation therewith. The control plate 63 has an upper end with an inner side that is formed with an abutment projection 631. The lower end of the control plate 63 is formed into a hook portion 632. One end of a tension spring 633, which serves as an arm control spring, is coupled to the hook portion 632. The other end of the tension spring 633 is connected to a retaining stub 37 on the bottom portion of the inner casing 3, thereby biasing the control plate 63 to rotate the arm pivoting shaft 62 relative to the inner casing 3 such that the arms 11 are pivoted from the lowered position to the raised position in order for the shielding member 12 to cover the face opening 104 of the head portion 102 of the toy body 1 (see FIG. 6).

Figure 5:
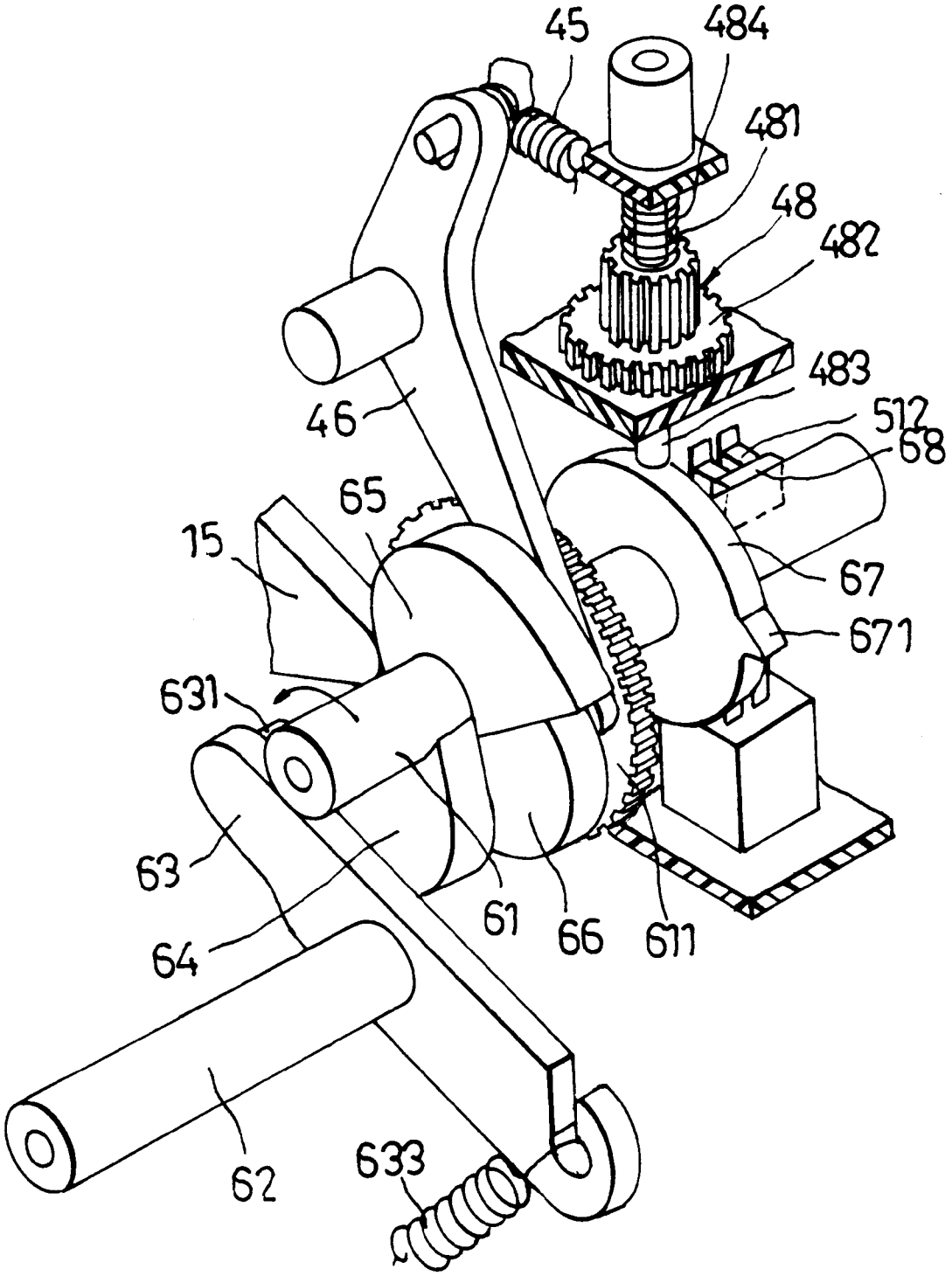
FIG. 5 is a perspective view illustrating cam members on a main shaft of the drive mechanism and the various components of the preferred embodiment that are associated operably with the cam members.

Referring to FIGS. 3 and 5, an arm control cam member 64, a casing control cam member 65, a locking control cam member 66, a face changing control cam member 67 and a cycle control cam member 68 are mounted on different sections of the main shaft 61 for co-rotation therewith in a counterclockwise direction.

Figure 6:
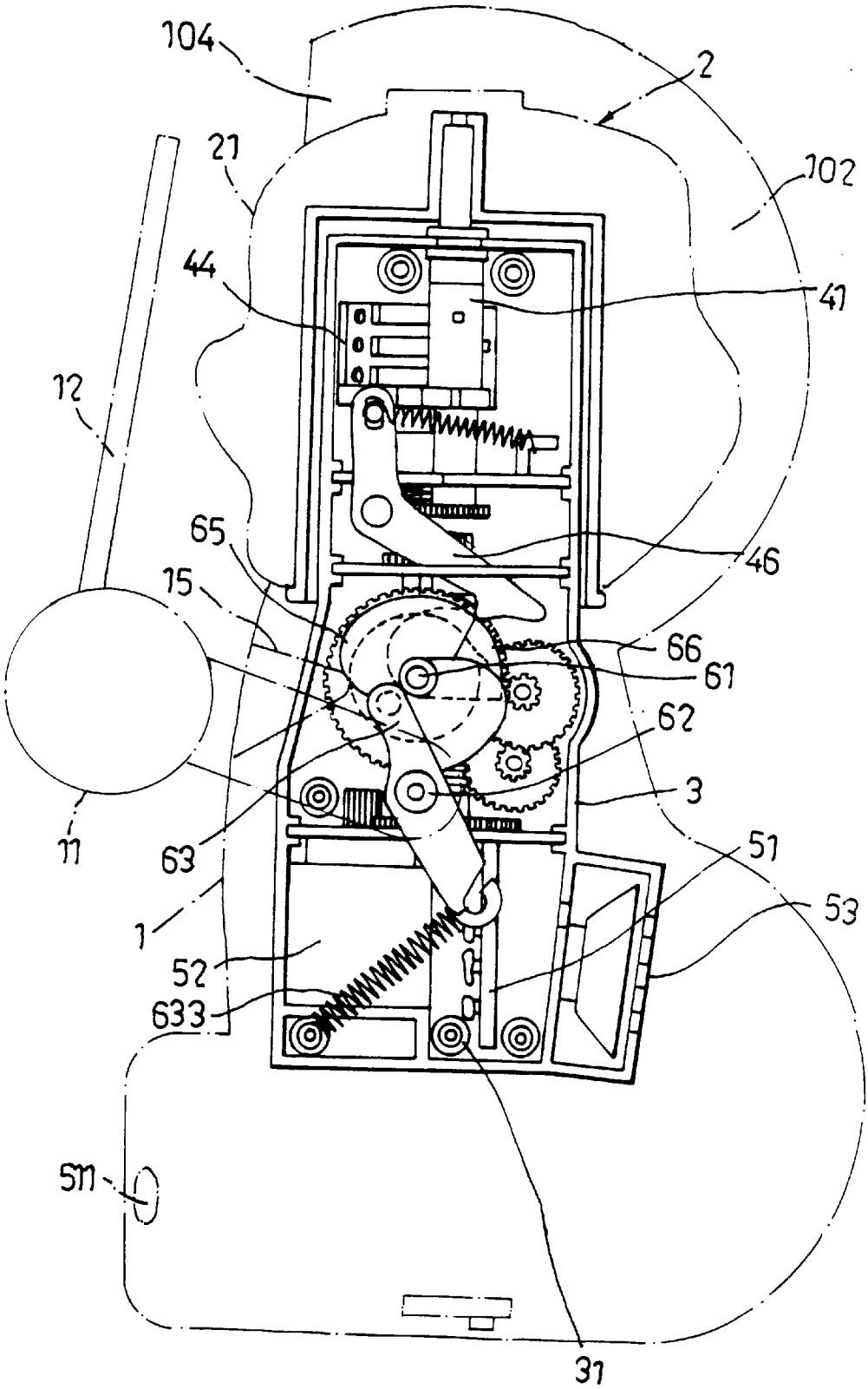
FIG. 6 is a schematic side view illustrating the preferred embodiment while the arms thereof are raised and an inner casing of the toy is pivoted rearwardly of the toy body.

The arm control cam member 64 has a cam edge that presses against the abutment projection 631 on the control plate 63 during rotation of the main shaft 61 to cause the upper end of the control plate 63 to pivot downwardly and move the arms 11 from the raised position to the lowered position against the action of the tension spring 633 to prevent the shielding member 12 from covering the face opening 104 of the head portion 102 of the toy body 1, as shown in FIG. 2, and that disengages the abutment projection 631 to enable the tension spring 633 to pull the lower end of the control plate 63 for upward pivoting movement of the upper end of the control plate 63 for moving the arms 11 from the lowered position to the raised position so that the shielding member 12 covers the face opening 104 of the head portion 102, as shown in FIG. 6.

The casing control cam member 65 has a cam edge that abuts against a wedge 15 (see FIG. 2) on an inner surface of the toy body 1 during rotation of the main shaft 61 to cause the inner casing 3 to pivot rearwardly in the toy body 1 about the pivot shaft 31 against the action of the tension spring 33, and that disengages the wedge 15 to enable the tension spring 33 to pull the inner casing 3 to pivot forwardly in the toy body about the pivot shaft 31.

The locking control cam member 66 has a cam edge that abuts against the lower end of the control arm 46 during rotation of the main shaft 61 for pivoting the control arm 46 in order to move the locking plate 44 away from the rotary shaft 41 against the action of the tension spring 45 so as to disengage the locking projection 442 from one of the locking grooves 43, and that disengages the lower end of the control arm 46 to enable the tension spring 45 to pull the upper end of the control arm 46 for pivoting of the latter so as to move the locking plate 44 toward the rotary shaft 41 for engagement between the locking projection 442 and one of the locking grooves 43.

The face changing control cam member 67 has a peripheral edge that is formed with a radial cam projection 671, and is disposed below the distal end face of the gear axle 483 of the clutch unit 48. When the cam projection 671 pushes the gear axle 483 upwardly, the upper clutch gear 481 moves upwardly to enable the clutch unit 48 to couple the drive gear 47 with the transmission gear 42 on the rotary shaft 41. When the cam projection 671 ceases to abut against the gear axle 483, the spring 484 expands to enable the upper clutch gear 481 to disengage the transmission gear 42 on the rotary shaft 41.

The cycle control cam member 68 is disposed adjacent to the circuit contact set 512 and is capable of pressing the same upon completion by the main shaft 61 of one cycle of rotation. When the select switch 57 is set so as to operate the circuit unit 5 in the automatic mode, upon detection of a change in the intensity of light detected by the light sensing unit 511, the control circuit 51 will activate the motor 52, thereby rotating the main shaft 61 until the cycle control cam member 68 once again presses the circuit contact set 512.

The operation of the preferred embodiment in the automatic mode will be described in greater detail in the succeeding paragraphs with reference to the drawings.

Referring again to FIGS. 1 and 2, initially, the arm control cam member 64 presses against the abutment projection 631 on the control plate 63 to cause the upper end of the control plate 63 to pivot downwardly and move the arms 11 from the raised position to the lowered position against the action of the tension spring 633 to prevent the shielding member 12 from covering the face opening 104 of the head portion 102 of the toy body 1. The face section 21 with the smiling facial expression protrudes out of the head portion 102 via the face opening 104 at this time.

Referring to FIGS. 3 and 6, when there is a change in the intensity of light that is detected by the light sensing unit 511, the control circuit 51 activates the motor 52, thereby rotating the motor shaft 521 thereof. Rotation of the motor shaft 521 results in corresponding counterclockwise rotation of the main shaft 61 due to the speed-reducing gear units 54, 55, 56. At this time, the cam edge of the arm control cam member 64 disengages the abutment projection 631 to enable the tension spring 633 to pull the lower end of the control plate 63 for upward pivoting movement of the upper end of the control plate 63, thereby moving the arms 11 to the raised position so that the shielding member 12 extends across the face opening 104 of the head portion 102 to cover the same. In addition, the cam edge of the casing control cam member 65 abuts against the wedge 15 on the toy body 1 to cause the inner casing 3 to pivot rearwardly in the toy body 1 about the pivot shaft 31 against the action of the tension spring 33 (see FIG. 2), thereby retracting the face section 21 of the face member 2 inwardly of the face opening 104 in order to minimize friction between the face member 2 and the toy body 1 when the face member 2 is rotated to change the facial expression of the toy. Moreover, the cam edge of the locking control cam member 66 abuts against the lower end of the control arm 46 for pivoting the control arm 46 in order to move the locking plate 44 away from the rotary shaft 41 against the action of the tension spring 45 so as to disengage the locking projection 442 from one of the locking grooves 43, thereby permitting rotation of the face member 2 relative to the toy body 1 at this time.

Figure 7:
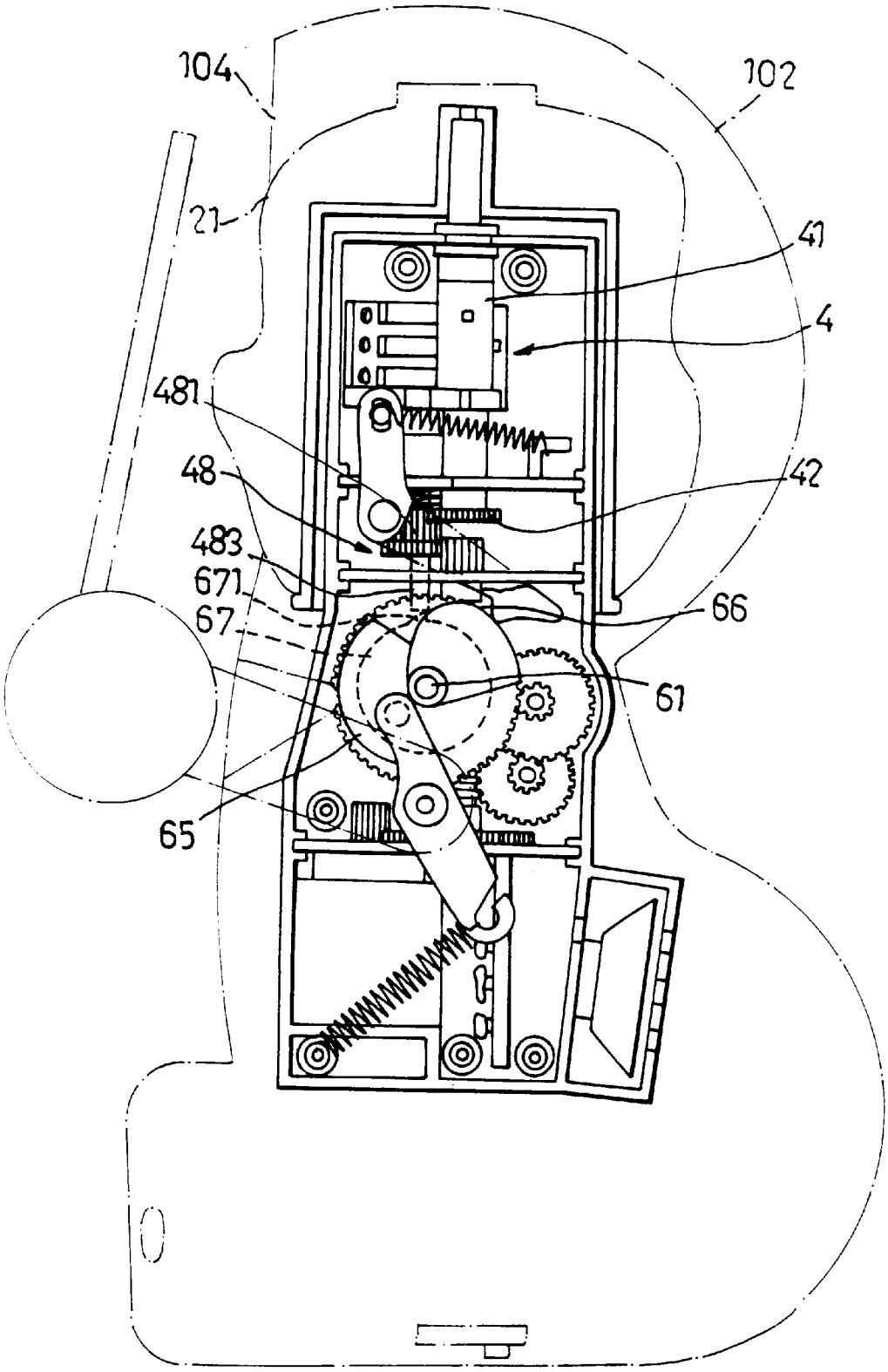
FIG. 7 is a schematic side view illustrating the preferred embodiment while the face member rotates to change the facial expression of the toy.

Referring to FIG. 7, further axial rotation of the main shaft 61 will cause the cam projection 671 on the face changing control cam member 67 to push the gear axle 483 upwardly, thereby moving the upper clutch gear 481 upwardly to enable the clutch unit 48 to couple the drive gear 47 with the transmission gear 42 on the rotary shaft 41. The rotary shaft 41 rotates to move a previous one of the face sections 21 on the face member 2 from alignment with the face opening 104 on the head portion 102 of the toy body 1 and register another one of the face sections 21 with the face opening 104.

Figure 8:
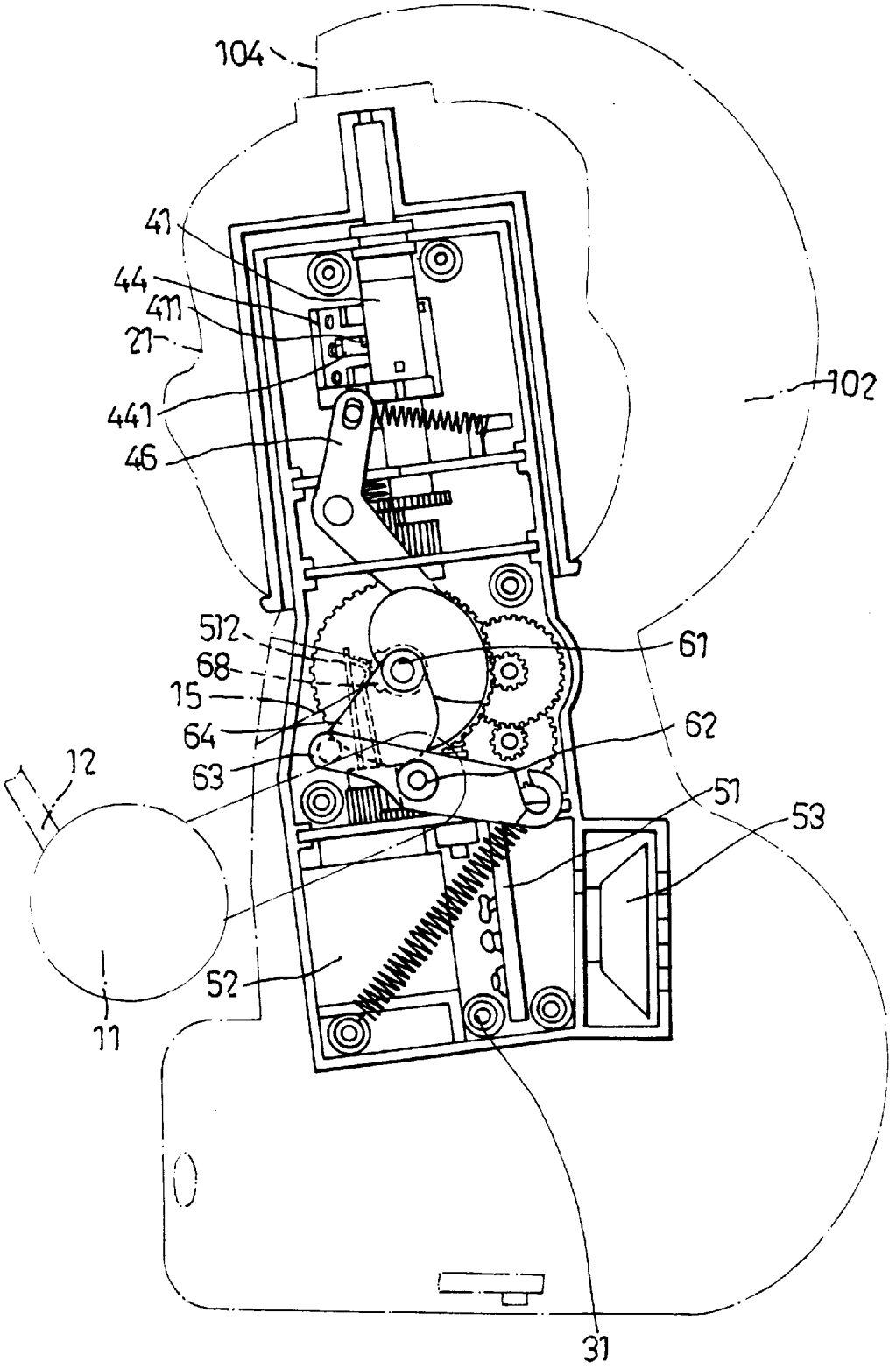
FIG. 8 is a schematic side view illustrating the preferred embodiment after the facial expression thereof has changed.

Referring to FIGS. 5 and 8, eventually, the cam projection 671 on the face changing control cam member 67 ceases to abut against the gear axle 483, thereby causing the spring 484 to expand so as to enable the upper clutch gear 481 to disengage the transmission gear 42 on the rotary shaft 41 and prevent the motor 52 from driving rotatably the rotary shaft 41 further. Thereafter, the cam edge of the locking control cam member 66 disengages the lower end of the control arm 46 to enable the tension spring 45 to pull the upper end of the control arm 46, thereby moving the locking plate 44 toward the rotary shaft 41 for engagement between the locking projection 442 and one of the locking grooves 43 to arrest further rotation of the rotary shaft 41 relative to the inner casing 3. Then, the cam edge of the casing control cam member 65 disengages the wedge 15 to enable the tension spring 33 (see FIG. 2) to pull the inner casing 3 to pivot forwardly in the toy body 1 about the pivot shaft 31. The aligned one of the face sections 21 on the face member 2 protrudes out of the head portion 102 via the face opening 104 at this time. The cam edge of the arm control cam member 64 subsequently presses against the abutment projection 631 on the control plate 63 to once again cause the upper end of the control plate 63 to pivot downwardly and move the arms 11 back to the lowered position, thereby enabling the shielding member 12 to uncover the face opening 104 of the head portion 102 and permit viewing of one of the face sections 21 of the face member 2. Finally, the cycle control cam member 68 presses the circuit contact set 512 to disable the control circuit 51 and deactivate the motor 52.

As described beforehand, the face changing operation of the preferred embodiment proceeds in sequence from the state shown in FIG. 2 to the states shown in FIGS. 6, 7 and 8. When comparing the state shown in FIG. 2 with that shown in FIG. 8, it should be noted that, in FIG. 8, since axial rotation of the rotary shaft 41 has occurred, the face section 21 that is visible from the face opening 104 in the head portion 102, such as the face section 21 with the sleeping facial expression of FIG. 9, or the face section 21 with the crying facial expression of FIG. 10, differs from that which can be seen in FIG. 2. According to the face section 21 that can be seen from the face opening 104, one of the radial projections 411 on the rotary shaft 41 contacts a corresponding sound select contact 441. In the state shown in FIG. 2, the lowermost radial projection 411 contacts the lowermost sound select contact 441. The sound select contacts 441 are connected electrically to the control circuit 51. Depending upon which one of the sound select contacts 441 is contacted, the control circuit 51 activates the speaker 53 to generate a corresponding audible sound output.

It should be noted that, in the preferred embodiment, random registering of one of the face sections 21 with the face opening 104 is possible during a face changing operation. That is to say, changing of the face sections 21 does not necessarily occur in sequence. This is due to slight differences in the motor speed and other factors. When the rotary shaft 41 stops rotating due to deactivation of the motor 52 by the control circuit 51, it is possible that one of the face sections 21 will not be registered exactly with the face opening 104. At this time, under the action of the tension spring 45, one of the triangular guide plates 431 that is disposed between two adjacent locking grooves 43 on the rotary shaft 41 will cooperate with the triangular locking projection 442 on the locking plate 44 to result in slight rotation of the rotary shaft 41 until engagement between the locking projection 442 and one of the locking grooves 43 occurs. One of the face sections 21 on the face member 2 is registered exactly with the face opening 104 of the toy body 1 at this time.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A toy with changing facial expression, comprising:

a hollow toy body having a torso section and a head section on said torso section, said head section having a front side formed with a face opening, said torso section being provided with a pair of forwardly extending arms that are mounted pivotally on two sides of said torso section, said arms having distal ends that hold a shielding member therebetween, and being pivotable on said torso section between a lowered position, where said shielding member uncovers said face opening, and a raised position, where said shielding member extends across said face opening to cover said face opening;

means, provided in said torso section and coupled to said arms, for moving said arms from said lowered position to said raised position, and from said raised position back to said lowered position;

a face member disposed rotatably in said head section of said toy body and formed with at least two face sections; and means, provided in said toy body and connected to said face member, for rotating said face member to move a previous one of said face sections from alignment with said face opening and register another one of said face sections with said face opening only when said arms are in said raised position.

2. The toy as claimed in claim 1, further comprising means for locking said face member in said toy body to prevent rotation of said face member relative to said toy body when said arms are in said lowered position.

3. The toy as claimed in claim 1, further comprising means for automatically activating said means for moving said arms and rotating said face member.

4. The toy as claimed in claim 1, further comprising means, provided in said toy body and connected to said face member, for retracting said face member inwardly from said face opening prior to rotating said face member, and for moving said face member outwardly toward said face opening subsequent to rotating said face member so that said face section protrudes from said face opening.

5. The toy as claimed in claim 1, wherein said means for rotating said face member registers said face sections with said face opening in a random order.

6. The toy as claimed in claim 1, wherein said face member has three face sections.

7. A toy with changing facial expression, comprising:

a hollow toy body having a torso section and a head section on said torso section, said head section having a front side formed with a face opening, said torso section being provided with a pair of forwardly extending arms that are mounted pivotally on two sides of said torso section, said arms having distal ends that hold a shielding member therebetween, and being pivotable on said torso section between a lowered position, where said shielding member uncovers said face opening, and a raised position, where said shielding member extends across said face opening to cover said face opening;

an inner casing disposed in said toy body and having top and bottom portions;

a circuit unit including a control circuit and a motor mounted on said bottom portion of said inner casing and connected electrically to said control circuit;

a drive mechanism including a main shaft disposed horizontally in said inner casing and mounted rotatably to said inner casing, said main shaft being coupled to said motor for axial rotation of said main shaft when said motor is activated by said control circuit, said main shaft having an arm control cam member and a face changing control cam member mounted thereon, a horizontal arm pivoting shaft mounted rotatably on said inner casing below said main shaft, said arm pivoting shaft having opposite ends that extend out of said inner casing and that have said arms of said toy body connected respectively thereto, an elongate control plate mounted securely on said arm pivoting shaft for co-rotation therewith, said control plate having upper and lower ends, and an arm control spring interconnecting said lower end of said control plate and said inner casing for biasing said control plate to rotate said arm pivoting shaft and pivot said arms from said lowered position to said raised position, said arm control cam member pressing against said upper end of said control plate during rotation of said main shaft to rotate said control plate and pivot said arms from said raised position to said lowered position against action of said arm control spring, and disengaging said upper end of said control plate to pivot said arms from said lowered position to said raised position due to the action of said arm control spring;

a hollow face member sleeved rotatably on said top portion of said inner casing and disposed in said head section of said toy body, said face member being formed with at least two face sections; and a face changing mechanism including an upright rotary shaft mounted rotatably on said inner casing and having an upper end which extends through said inner casing and which is connected to said face member for rotating said face member therewith, said rotary shaft further having a lower end provided with a transmission gear, and a clutch unit mounted on said inner casing and operable in an engaging mode, where said clutch unit couples said motor and said transmission gear such that rotation of said motor results in corresponding rotation of said rotary shaft, and a disengaging mode, where said clutch unit disengages said transmission gear from said motor to prevent said motor from driving rotatably said rotary shaft, said face changing control cam member operating said clutch unit in said engaging mode during rotation of said main shaft to rotate said face member so as to move a previous one of said face sections from alignment with said face opening and register another one of said face sections with said face opening while said arms are in said raised position, and in said disengaging mode to stop rotation of said face member by said motor when said arms are in said lowered position so that said another one of said face sections is visible from said face opening.

8. The toy as claimed in claim 7, wherein:

said main shaft further has a locking control cam member mounted thereon;

said rotary shaft being formed with at least two angularly spaced locking grooves that correspond respectively to said face sections on said face member;

said face changing mechanism further including a locking plate retained pivotally in said inner casing on one side of said rotary shaft, said locking plate being provided with a locking projection for engaging one of said locking grooves to arrest rotation of said face member relative to said inner casing when said arms are in said lowered position, a locking control spring having one end connected to said locking plate and an opposite end connected to said inner casing to bias said locking plate toward said rotary shaft for secure engagement between said locking projection and said rotary shaft, and a control arm mounted pivotally on said inner casing and having an upper end connected pivotally to said locking plate, and a lower end, said locking control cam member abutting against said lower end of said control arm during rotation of said main shaft to pivot said control arm and move said locking plate away from said rotary shaft against action of said locking control spring to permit rotation of said rotary shaft when said arms are moved to said raised position, and disengaging said lower end of said control arm to permit movement of said locking plate toward said rotary shaft due to the action of said locking control spring when said arms are moved to said lowered position.

9. The toy as claimed in claim 8, wherein:

said rotary shaft is formed with at least two radial projections that correspond to said face sections, that are spaced apart in an axial direction of said rotary shaft, and that are angularly spaced apart on said rotary shaft;

said locking plate having at least two sound select contacts corresponding to said radial projections provided thereon and connected electrically to said control circuit, one of said sound select contacts being contacted by a corresponding one of said radial projections when said locking projection engages one of said locking grooves;

said circuit unit further including a speaker mounted to said bottom portion of said inner casing and connected electrically to and controlled by said control circuit so as to generate an audible sound output corresponding to the contacted one of said sound select contacts.

10. The toy as claimed in claim 8, wherein said rotary shaft further has at least two guide plates, each of which projects radially from said rotary shaft and is disposed between a corresponding adjacent pair of said locking grooves to guide engagement between said locking projection and said rotary shaft.

11. The toy as claimed in claim 7, wherein said bottom portion of said inner casing is mounted pivotally in said torso section of said toy body for forward and rearward pivoting movement relative thereto, said toy further comprising a casing control spring which interconnects said inner casing and said toy body to bias said inner casing to pivot forwardly and enable said face sections of said face member to protrude out of said face opening when registered with said face opening, said torso section being further provided with a wedge therein, said main shaft further having a casing control cam member mounted thereon, said casing control cam member abutting against said wedge during rotation of said main shaft to pivot said inner casing rearwardly in said toy body and retract said face sections inwardly of said face opening against action of said casing control spring in order to minimize friction between said face member and said toy body when said face member rotates, and disengaging said wedge to permit forward pivoting movement of said inner casing due to the action of said casing control spring when said arms are moved to said lowered position.

12. The toy as claimed in claim 7, wherein said circuit unit further includes a light sensing unit mounted on said toy body and connected electrically to said control circuit to permit activation of said motor by said control circuit upon detection of a change in light intensity.

13. The toy as claimed in claim 12, wherein said circuit unit further includes a circuit contact set mounted on said inner casing and connected electrically to said control circuit to permit deactivation of said motor by said control circuit when said circuit contact set is depressed, said main shaft further having a cycle control cam member mounted thereon for depressing said circuit contact set upon completion by said main shaft of one cycle of rotation.

* * * * *